US008483590B2

(12) United States Patent
McNamee et al.

(10) Patent No.: US 8,483,590 B2
(45) Date of Patent: Jul. 9, 2013

(54) METHOD AND APPARATUS FOR EXTERNAL HEATER ROLL CLEANING

(75) Inventors: Brian John McNamee, Brockport, NY (US); John M. Derimiggio, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 384 days.

(21) Appl. No.: 12/901,068

(22) Filed: Oct. 8, 2010

(65) Prior Publication Data

US 2012/0087702 A1 Apr. 12, 2012

(51) Int. Cl.
*G03G 21/00* (2006.01)
*G03G 15/20* (2006.01)

(52) U.S. Cl.
USPC ..... 399/99; 399/327

(58) Field of Classification Search
USPC ..... 399/327, 347, 99
See application file for complete search history.

(56) References Cited

U.S. PATENT DOCUMENTS 4,607,947 A * 8/1986 Ensing et al. ..... 399/327
4,870,465 A * 9/1989 Lindblad et al. ..... 399/347
5,162,856 A * 11/1992 Hayashida et al.
5,749,037 A * 5/1998 Takayuki ..... 399/327
2006/0159496 A1* 7/2006 Mikita et al. ..... 399/327
2007/0254233 A1* 11/2007 Fujimoto et al.
2008/0138126 A1* 6/2008 Viney et al. ..... 399/327
2010/0061778 A1* 3/2010 Kagawa ..... 399/327
2010/0111578 A1* 5/2010 Derimiggio et al. ..... 399/327
2011/0135352 A1* 6/2011 Takada ..... 399/327

FOREIGN PATENT DOCUMENTS

JP 2010061113 A * 3/2010

* cited by examiner

*Primary Examiner* — Susan Lee
(74) *Attorney, Agent, or Firm* — Ronald E. Prass, Jr.; Prass LLP

(57) ABSTRACT

According to aspects of the embodiments, there is provided an apparatus and method to maintain a clean and effective external heat roll surface in a printing system. The disclosed embodiment's uses a cleaning roller in contact with the external heat rollers designed to dislodge and displace contamination products that would otherwise accumulate on and in the external heat roller rough surface. The cleaning roller rotates concurrently with the heating roller so that the cleaning media cleans the roller from a picking action as opposed to a wiping motion. This provides maximum cleaning action with the undesirable wear and tear of the bristles that would occur with the conventional method of a wiping motion.

20 Claims, 7 Drawing Sheets

METHOD AND APPARATUS FOR EXTERNAL HEATER ROLL CLEANING

BACKGROUND

This disclosure relates in general to copier/printers, and more particularly, to cleaning residual toner from an external heater roll and system for cleaning and rejuvenating an external surface of a fusing member in a toner image producing machine.

In a typical electrophotographic printing process, a photoreceptor or photoconductive member is charged to a uniform potential to sensitize the surface thereof. The charged portion of the photoconductive member is exposed to a light image of an original document being reproduced. Exposure of the charged photoconductive member selectively dissipates the charges thereon in the irradiated areas. This process records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. Toner particles attracted from the carrier granules to the latent image form a toner powder image on the photoconductive member. The toner powder image is then transferred from the photoconductive member to a copy sheet. Heating of the toner particles permanently affixes the powder image to the copy sheet. After each transfer process, the toner remaining on the photoconductor is cleaned by a cleaning device.

In order to fix permanently or fuse the toner material onto a substrate or support member such as plain paper by heat, it is necessary to elevate the temperature of the toner material to a point at which constituents of the toner material coalesce and become tacky. This action causes the toner to flow to some extent onto the fibers and/or into the pores of the support member or otherwise upon the surface thereof. Thereafter, as the toner material cools, solidification of the toner material occurs causing the toner material to be bonded firmly to the support member.

Most current fusing systems include a system for automatically cleaning the fuser roll and/or supplying the fuser roll with a lubricant or release agent. For example, the surface of the fuser roll may be cleaned and/or lubricated by means of a web that is pressed against the surface of the fuser roll at a location generally away from the nip formed by the pressure and fuser rolls. The webs of known systems provide either a textured surface or a tacky or sticky surface for removing adhered toner particles from the fuser roll. The web may also provide amounts of lubricant or release agent to the fuser roll. However, web cleaning techniques are not capable of driving contamination out of the valleys of the rough surface. This material stays bonded to the support member leading to a reduction in the functionality of the surface.

For the reasons stated above, and for other reasons stated below which will become apparent to those skilled in the art upon reading and understanding the present specification there is need in the art for systems, apparatus, and/or methods that cleans and remove bonded material from a surface.

SUMMARY

According to aspects of the embodiments, there is provided an apparatus and method to maintain a clean and effective external heat roll surface in a printing system. The disclosed embodiment's uses a cleaning roller in contact with the external heat rollers designed to dislodge and displace contamination products that would otherwise accumulate on and in the external heat roller rough surface. The cleaning roller rotates concurrently with the heating roller so that the cleaning media cleans the roller from a picking action as opposed to a wiping motion. This provides maximum cleaning action with the undesirable wear and tear of the bristles that would occur with the conventional method of a wiping motion.

DETAILED DESCRIPTION

Figure 1:
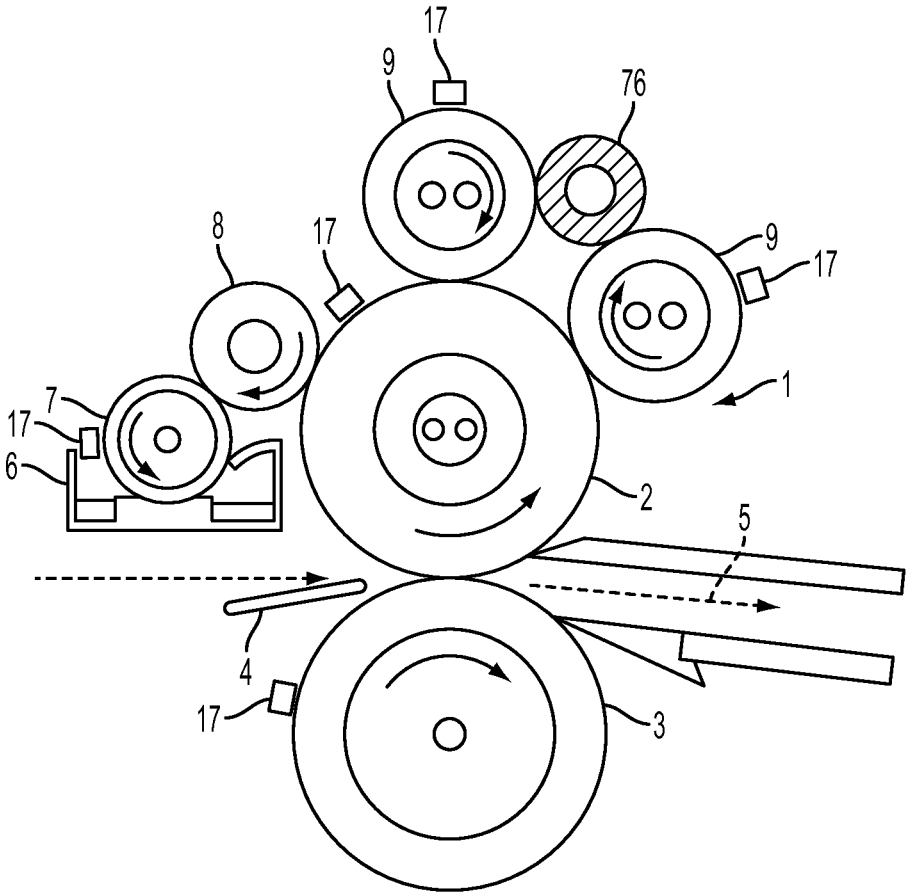
FIG. 1 illustrates a fuser system in an electrostatic marking apparatus using a cleaning roller to clean an external roll in accordance to an embodiment.

In accordance with various aspects described herein, systems and methods are described that facilitate cleaning a surface in a xerographic imaging device using a cleaning roller. The cleaning roller system comprises a shaft and a cleaning medium mounted around the shaft forming a cylinder. The shaft is mounted in an apparatus that captures the ends of the shaft in sealed bearings and allows for rotation concurrent with the motion of the external heat rollers. A load is applied to the mounting apparatus such that the normal force between the cleaning roller and the external heat roller is sufficient to provide traction drive to the cleaning roller. The cleaning roller is allowed to roll freely against the heat roller where the brush tips or abrasive points come in to contact with the external roll.

Aspects of the disclosed embodiments relate to a contact cleaner roll cleaning system in a printing system comprising a frame; a movable surface having a major surface with debris thereon; a rotatable cleaner roll supported on the frame disposed for rolling contact with the major surface, wherein the rotatable cleaner roll has a textured outer surface with embedded sharp grit to remove the debris on the movable surface; and a controller to control the rotational speed of the rotatable cleaner roll relative to the movable surface.

In yet another aspect the disclosed embodiment is to a system wherein the speed of the cleaner roll is matched to the linear surface speed as the movable surface it is cleaning.

In yet another aspect the disclosed embodiment is to a system wherein the movable surface is selected from the group consisting external heat roll, belt fuser, spreader.

In yet another aspect the disclosed embodiment is to a system wherein the rotatable cleaner roll is formed from a material having a surface energy which allows the debris to be dislodged and displaced from the major surface.

In yet another aspect the disclosed embodiment is to a wherein the rotatable cleaner roll comprise a brush made of wire or other stiff fibers that can withstand a movable surface operating temperature.

In yet another aspect the disclosed embodiment is to a wherein the material for the sharp grit selected from the group consisting of alumina, tungsten carbide or silica.

In yet another aspect the disclosed embodiment is to a wherein the dislodged material is carried out by a print media in the printing system.

Aspects of the disclosed embodiments relate to a method of cleaning a surface in a printing system, the method comprising moving a movable surface having a major surface with debris thereon; rotating a rotatable cleaner roll supported on a frame disposed for rolling contact with the major surface, wherein the rotatable cleaner roll has a textured outer surface with embedded sharp grit to remove the debris on the movable surface; and controlling the rotational speed of the rotatable cleaner roll relative to the movable surface.

Aspects of the disclosed embodiments relate to a fusing system used in an electrophotographic imaging apparatus comprising in an operative relationship, at least one external heat roll, a fuser roll, a pressure roll, and a rotatable cleaner roller, the rotatable cleaner roll has a textured outer surface with embedded sharp grit enabled to clean the at least one external heat roll, the fuser roll in operative contact at a first location with the pressure roll, the fuser roll in operative contact at a second location with the at least one external heat roll, an external heat roll having two functions, to transfer heat to the fuser roll and to clean the debris or contamination from the fuser roll surface, said external heat roll having a predetermined surface roughness extending throughout its length and having substantially a same length as the fuser roll, and enabled to contact substantially the entire length of the fuser roll and enabled to effectively remove debris on substantially any portion of the surface of the fuser roll in a cleaning step.

In yet another aspect the disclosed embodiment is to a cleaning cartridge to remove debris from a movable surface comprising a frame; and a rotatable cleaner roll supported on the frame disposed for rolling contact with the major surface, wherein the rotatable cleaner roll has a textured outer surface with embedded sharp grit to remove the debris on the movable surface.

The term "print media" generally refers to a usually flexible, sometimes curled, physical sheet of paper, plastic, or other suitable physical print media substrate for images, whether precut or web fed.

The term "image forming machine" as used herein refers to a digital copier or printer, electrographic printer, bookmaking machine, facsimile machine, multi-function machine, or the like and can include several marking engines, as well as other print media processing units, such as paper feeders, finishers, and the like. The term "electrophotographic printing machine," is intended to encompass image reproduction machines, electrophotographic printers and copiers that employ dry toner developed on an electrophotographic receiver element.

FIG. 1, a fuser system 1 is illustrated having a fuser roll 2, a pressure roll 3 and a paper transport 4 which directs a paper-receiving medium 5 through a nip between rolls 2 and 3. The arrows on fuser roll 2 and pressure roll 3 indicate the rotational direction of each roll. A release agent reservoir 6 is shown in operative relationship to a meter roll 7 and a donor roll 8. In operative contact with the fuser roll 2 are two external heat rolls 9 (X-rolls), the X-rolls 9 are both in contact with a cleaning roll 76. The cleaning roller 76 is mounted in an apparatus that captures the ends of the shaft in sealed bearings and allows for rotation concurrent with the motion of the external heat rollers 9. The cleaning roller 76 can be rotated at a freewheeling mode or a directed mode. In the freewheeling mode the cleaning roll 76 rides on and at the speed of the movable surface which is selected from a group consisting of external heat roll, fuser roll, belt fuser, or spreader. In the directed mode, the rotational speed of the cleaning roll 76 is control by a mechanism such as a motor or computer controlled servos independent of the movable surface, A scavenging agent, EDTA (in the form of tetrasodium salt) is released on to the fuser roll. A measured amount of EDTA transfers to existing X-rolls 9 and from X-rolls 9 to the surface of fuser roll 2. This inhibits formation of debris such as Zn fumarate and other contaminates from forming on the surface of fuser roll 2. The Zn fumarate (originating from Zn stearate in toner) contaminate causes print defects and premature development of offset. By using existing components of the fuser system 1 such as the web 10 and the X-rolls 9, an additional cleaning station as used in some prior art need not be installed in system 1. Since space is always a serious consideration in marking or electrophotographic systems, avoiding the necessity of a cleaning station is important. Also, using the cleaning roller 76 and X-rolls 9 to inhibit contamination of the fuser roll 2 avoids the necessity of removing the fuser roll for external cleaning. The cleaning roller consists of a shaft and a cleaning medium mounted around the shaft forming a cylinder. This down time of system 1 is important time-wise and monetarily. Element 17 located adjacent rollers 2, 3 and 9 are thermostats.

Figure 2:
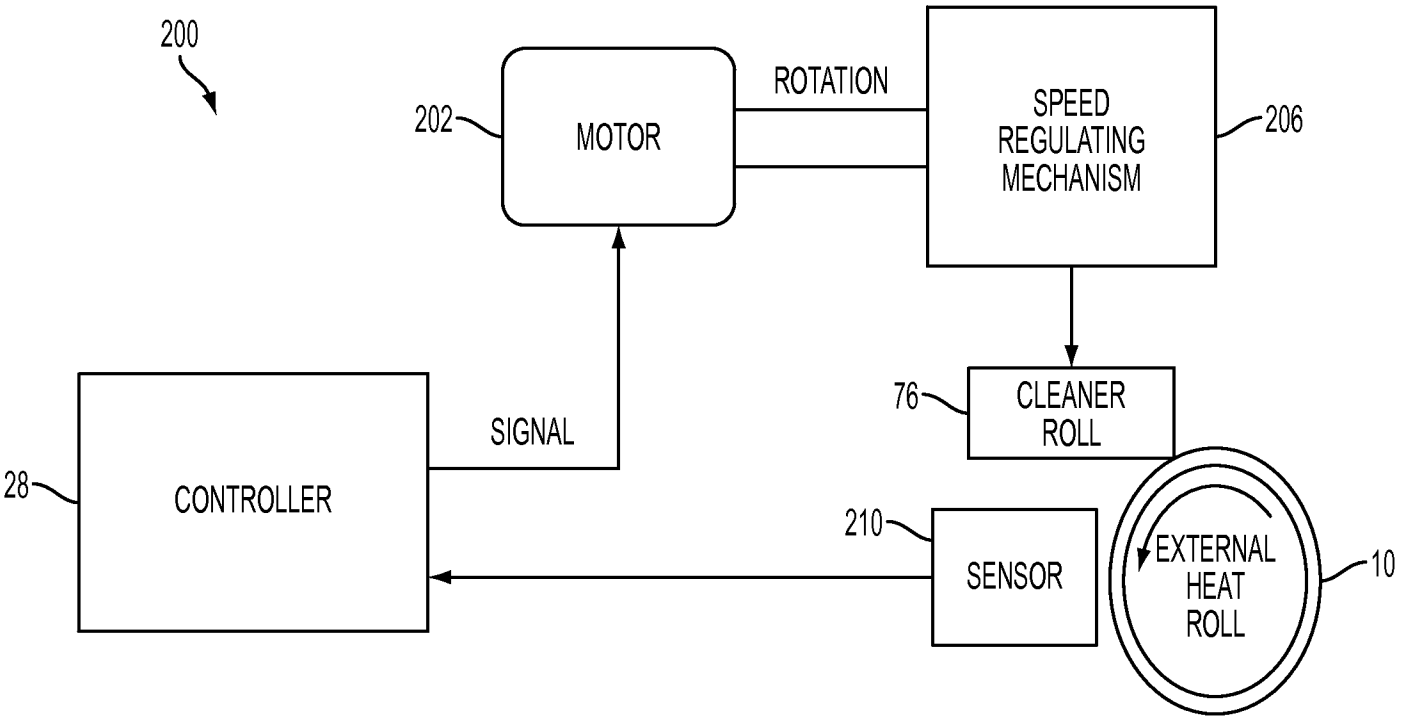
FIG. 2 is a schematic of a single stepper motor system used in the cleaning roller system of FIG. 1 to control cleaner roller speed in accordance to an embodiment.

FIG. 2 is a schematic of a single stepper motor system used in the cleaning roller system of FIG. 1 to control cleaner roller speed in accordance to an embodiment Rotation of cleaning roller 76 through speed regulating mechanism 206, which could be a shaft, cams, guide slots, or other conventional mechanism, controls the speed of rotation for the cleaning roller in the assembly. By controlling the amount of rotation, the rotational speed of the cleaning roller can be varied. The speed regulating mechanism 206 rotates to move the cleaning roller 76 and to move the roller against a moving surface such as a external heat roll, belt fuser, spreader, drum rotating in an operational direction, a flat surface moving in an operational direction, or a photoreceptor belt moving in an operational direction, which has a direction of rotation indicated by the arrow at the bottom of roller 10 which is equivalent to roller 9 in FIG. 1. A load is applied to the mounting apparatus such that the normal force between the cleaning roller 76 and the external heat roller is sufficient to provide traction drive to the cleaning roller. The cleaning roller is allowed to roll freely against the heat roller where the brush tips or abrasive points come in to contact with the external roll. A stepper motor 202 is used to provide rotation of cleaning roller 76 in defined increments. A sensor 210 is positioned at the X-Roll to provide a detection system that detects the operating cycle for the moving surface. The detection system or the sensor to detect an operating cycle can include a program module or routine that through various timing signals can ascertain when the machine or printer is going to be cycled up or down and most importantly when the speed of the cleaning surface is going to change. This information can then be communicated to the controller that operates the speed regulating mechanism 206. The output from the sensor is input to a controller 28. Controller 28 sends a signal to stepper motor 202 to increase the speed of the cleaning roller until a signal sensor 210 indicates a change in the operating cycle. When the cleaning roller is set to rotate at the same linear surface speed as the roll it is cleaning and is allowed to spin freely against the x-roll a picking rather than a wiping/rubbing action accomplished to do the cleaning. The picking action provides maximum cleaning action with the undesirable wear and tear of the bristles that would occur with the conventional method of a wiping motion.

Figure 3:
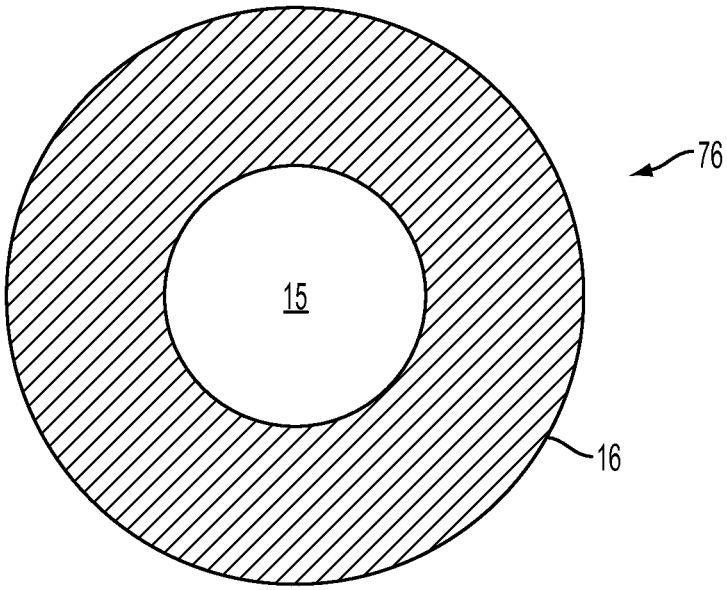
FIG. 3 is a cross-sectional view of a cleaning roller in accordance to an embodiment.

FIG. 3 is a cross-sectional view of a cleaning roller in accordance to an embodiment. The cleaning roller 76 consists of a shaft 15 and a cleaning medium 16 mounted around the shaft forming a cylinder. The shaft is mounted in an apparatus that captures the ends of the shaft in sealed bearings and allows for rotation concurrent with the motion of the external heat rollers. The cleaning medium 16 is formed from a material having a surface energy which allows the debris to be dislodged and displaced from the major surface such as the X-Roll 9. The cleaning medium 16 can be a brush made of wire or other stiff fibers that can withstand a surface's operating temperature. In the preferred embodiment cleaning medium 16 is made from a material with the sharp grit selected from the group consisting of alumina, tungsten carbide or silica. The type of debris being removed is instructive of the material used for the cleaning medium 16. As a general rule the cleaning medium should be harder than the debris material being removed, but softer than the surface being cleaned. Example of debris material in the printing arts is toner and ink that are amorphous soft. Material that is brittle such as toner is ideal for the shattering and dislodging action that occurs when the cleaning medium 16 rubs against the cleaning surface. The amorphous soft material such as phase change ink as described in FIG. 7 would require softer bristles such as nylons to dislodge and displace the debris from the surface.

Figure 4:
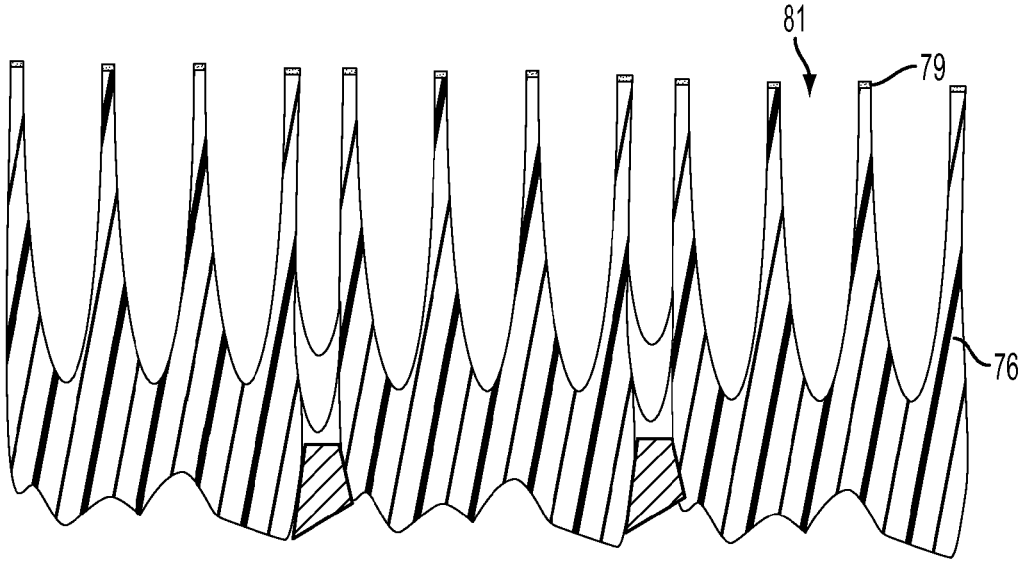
FIG. 4 is a fragmentary enlarged cross-sectional view of the cleaning roller in accordance to an embodiment.

FIG. 4 is a fragmentary enlarged cross-sectional view of the cleaning roller in accordance to an embodiment. The surface of the cleaning roller 76 lies in a cylindrical plane and comprises a plurality of recesses or cells 81 separated by contact areas 79. The cells 81 are formed substantially uniformly in the surface of the cleaning roll 76. The recesses or cells 81 have openings that lie in the cylindrical plane. The contact area 79, which form the cleaning medium 16, is grit-blasted to create a surface with roughness having a discernable pattern. As noted earlier suitable grit materials are alumina, tungsten carbide or silica. It must be emphasized that the grit is what gives the cleaning roller 76 the ability to dislodge the toner material that has bonded firmly to the support member. The grit dislodges the toner and to be displaced from its entrenched position. Once dislodged material/toner is carried out by a print media in the printing system. The microscopic debris sticks to the paper/media and s carried out un-noticed with the prints. Suitable lengths for the contact area 79 or individual bristle is in the range of one tenth of an inch (0.1") to one inch (1"), with half an inch (0.5") as the preferred height. The diameter of the contact area 79 is in a range of three one thousandth of an inch (0.003") to fifteen one thousandth of an inch (0.015"), with 0.006"-0.009" the preferred range. The recesses or cells 81 that is the bristle spacing should be around one to ten times (1.05 to 10 the diameter of contact area 79. The spacing and the length should be selected to meet the demand of dislodging random contamination or debris with size distribution fifty microns (50 u) to one thousand microns (1000 u).

Figure 5:
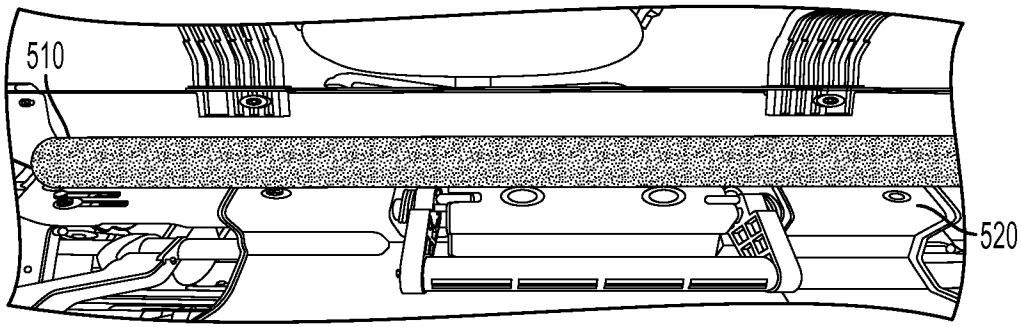
FIG. 5 is a view of the cleaning roller and the external heat roll in accordance to an embodiment.

FIG. 5 is a view of the cleaning roller and the external heat roll in accordance to an embodiment. Cleaning roller 510 is shown cleaning external roller 520.

Figure 6:
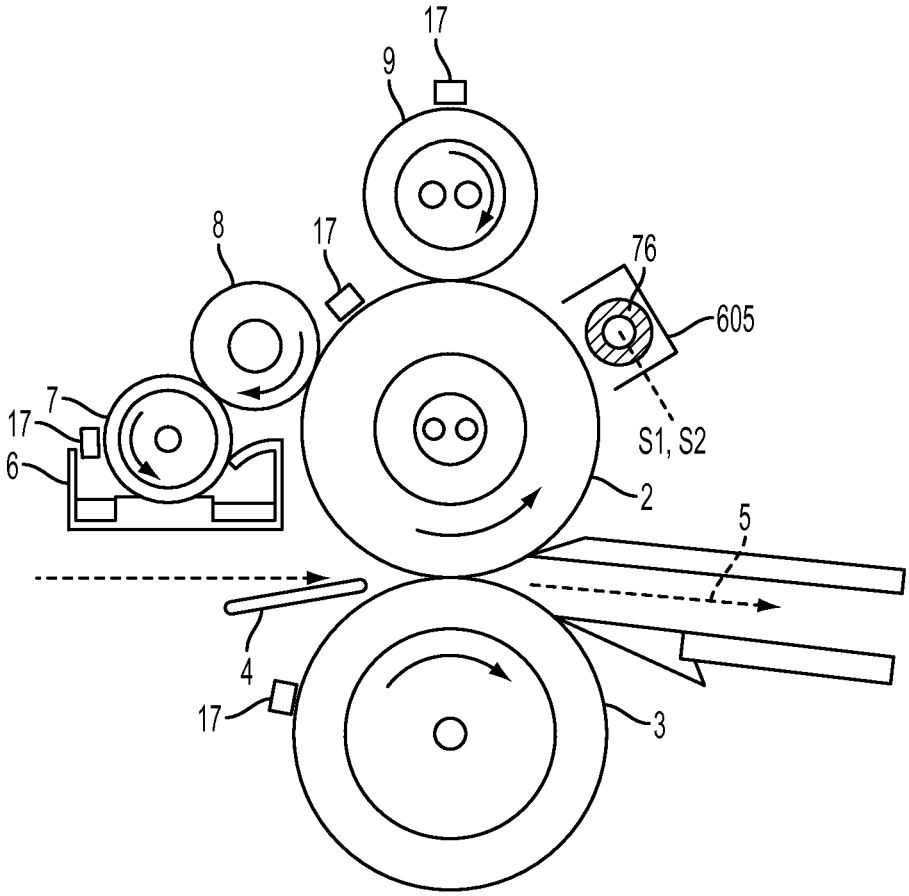
FIG. 6 illustrates a fuser system in an electrostatic marking apparatus using a cleaning cartridge with roller to clean a fuser roll in accordance to an embodiment.

FIG. 6 illustrates a fuser system in an electrostatic marking apparatus using a cleaning cartridge with roller to clean a fuser roll in accordance to an embodiment. The fuser system is explained above with reference to FIG. 1. The cleaning roll 76 is encapsulated in a replaceable cleaning cartridge 605 such as disclosed in U.S. Pat. No. 5,826,132 which is incorporated herein be reference in its entirety. As a minimum the cleaning cartridge should have a frame where rotatable cleaner roll such cleaning roll 76 is supported on the frame and is disposed for rolling contact with a movable surface such as fuser roll 2.

Figure 7:
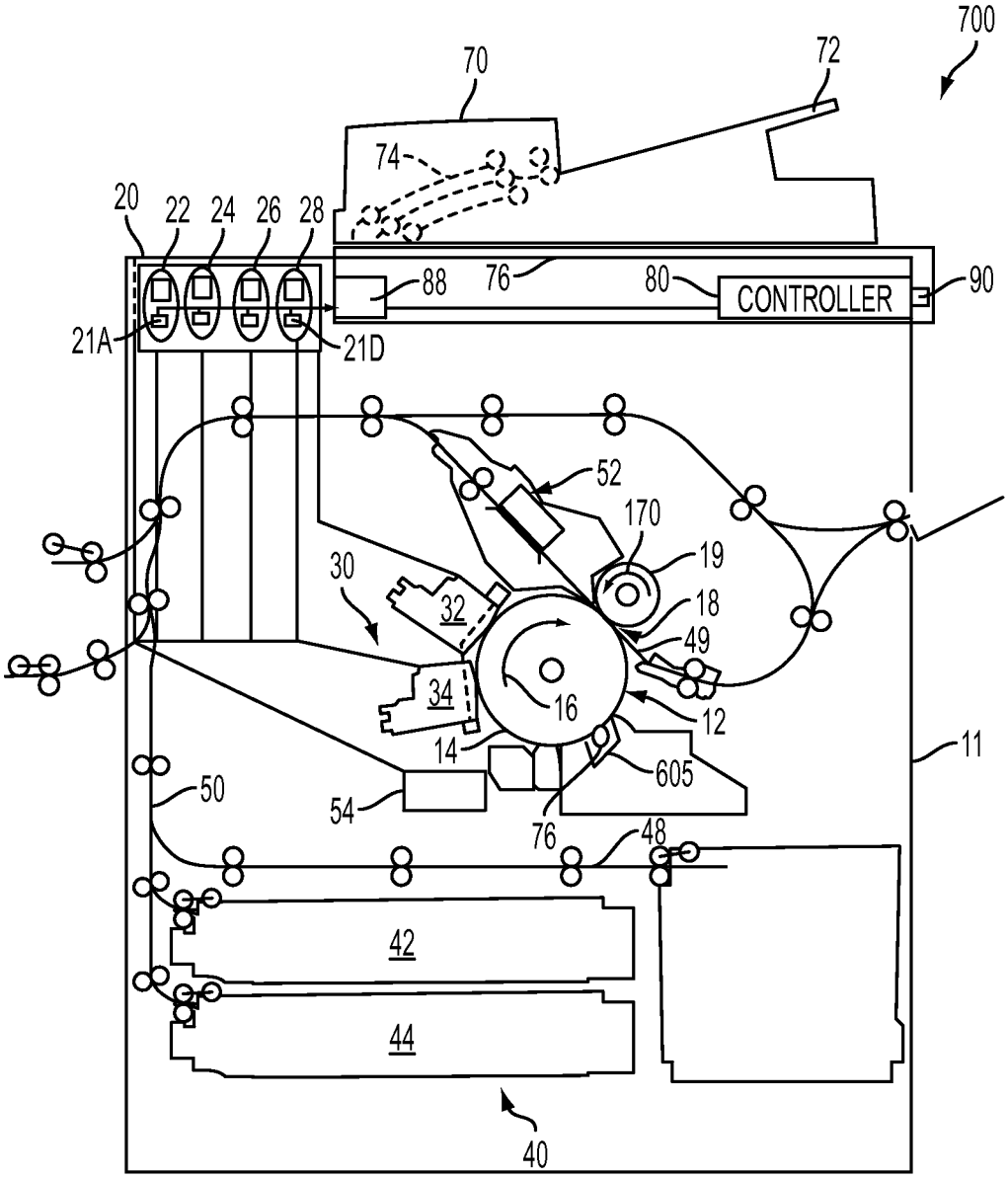
FIG. 7 is an illustration of a solid ink printer with cleaning cartridge in accordance to an embodiment.

FIG. 7 is an illustration of a solid ink printer with cleaning cartridge in accordance to an embodiment. FIG. 7 is a simplified elevational view of a phase change ink image producing machine 700 or solid ink (SI) printer. As illustrated, the solid ink printer 700 includes a frame 11 to which are mounted directly or indirectly all its operating subsystems and components, as described below. To start, the solid ink printer 700 includes an imaging member 12 that is shown in the form of a drum, but can equally be in the form of a supported endless belt. The imaging member 12 has an imaging surface 14 that is movable in the direction 16, and on which phase change ink images are formed. A heated transfix roller 19 rotatable in the direction 170 is loaded against the surface 14 of drum 12 to form a transfix nip 18, within which ink images formed on the surface 14 are transfixed onto a heated copy sheet 49. In the phase change ink image producing machine 700, the printing process begins with a maintenance drum/roller (not shown) applying a microscopic layer of silicone oil to facilitate ink release from the drum 12. Melted ink from the feed system flows into an ink reservoir in a printhead 32 and 34. Some of the ink solidifies and lodges itself onto the surface of the drum 12. A cleaning cartridge 605 with cleaning roll 76 as described above with FIG. 6 is used to dislodge and displaced the debris from drum 12. Since the ink may be amorphous soft a cleaning roll 76 with soft bristle such as nylon could be used for this purpose. The dislodged and displaced debris is then carried away in the printed sheet or substrate.

The solid ink printer 700 includes a phase change ink loader 20 that is configured to receive phase change ink in solid form, referred to herein as solid ink or solid ink sticks. The ink loader 20 also includes a phase change ink melting assembly (not shown) for melting or phase changing the solid form of the phase change ink into a liquid form. Phase change ink is typically solid at room temperature. The ink melting assembly is configured to heat the phase change ink to a melting temperature selected to phase change or melt the solid ink to its liquid or melted form. Currently, common phase change inks are typically heated to about 700.degree. C. to 160.degree. C. to melt the solid ink for delivery to the printhead(s). Thereafter, the phase change ink handling system is configured to communicate the molten phase change ink to a printhead system including one or more printheads, such as printhead 32 and 34. Any suitable number of printheads or printhead assemblies may be employed.

As further shown, the phase change ink image producing machine or SI printer 700 includes a substrate supply and handling system 40. The substrate supply and handling system 40, for example, may include sheet or substrate supply sources 42, 44, 46, 48, of which supply source 48, for example, is a high capacity paper supply or feeder for storing and supplying image receiving substrates in the form of cut sheets 49, for example. The substrate supply and handling system 40 also includes a substrate or sheet heater or preheater assembly 52. The SI printer 700 as shown may also include an original document feeder 70 that has a document holding tray 72, document sheet feeding and retrieval solid ink printers 74, and a document exposure and scanning system 76.

Operation and control of the various subsystems, components and functions of the machine or SI printer 700 are performed with the aid of a controller or electronic subsystem (ESS) 80 which is similar to controller 28 described in FIG. 2. The ESS or controller 80 for example, may be a self-contained, dedicated mini-computer having a central processor unit (CPU), electronic storage, and a display or user interface (UI). The ESS or controller 80 for example includes sensor input and control as well as a pixel placement and control if needed for the printing operation. In addition the controller 80 reads, captures, prepares and manages the image data flow between image input sources such as the scanning system 760, or an online or a work station connection 90, and the printhead assemblies 32, 34, 36, 38. As such, the ESS or controller 80 is the main multi-tasking processor for operating and controlling the machine subsystems and functions.

As illustrated, the solid ink printer 700 is a multicolor imaging solid ink printer includes a phase change ink handling system 20 configured for use with multiple different colors of solid ink, typically cyan 22, magenta 24, yellow 26, and black 28 (CMYK). The solid ink printer 700, however, may be configured to use more or fewer different colors or shades of ink. The melting assembly (not shown) includes an thermally conductive ink melt perimetric constraint 54 formed by one or multiple vertically oriented side wall(s) that at least partially enclose an internal melting area that is configured to expose a solid ink stick received therein to a much greater surface area than is generally possible using a flat heated plate.

Ink sticks (22, 24, 26, and 28) of each color are delivered through a corresponding individual one of the feed channels. Each of the ink sticks (22, 24, 26, and 28) includes an electronically-readable memory device 21A-21D, also known as a customer replaceable unit monitor or CRUM. With electrical connection between the individual CRUM and a coupler 88 can read the electronic data from the CRUM and/or write electronic data to the CRUM. The coupler 88 is connected to controller 80 to provide exchange of data with work stations and other computers.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

It is believed that the foregoing description is sufficient for purposes of the present application to illustrate the general operation of an electrophotographic printing machine. Moreover, while the present invention is described in an embodiment of a single color printing system, there is no intent to limit it to such an embodiment. On the contrary, the present invention is intended for use in multi-color printing systems as well, or any other printing system having a cleaner blade and toner. It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the followings claims.

What is claimed is:

1. A contact cleaner roll cleaning system in a printing system comprising:

a frame;

a movable surface having a major surface with debris thereon; and a rotatable cleaner roll supported on the frame disposed for rolling contact with the major surface, wherein the rotatable cleaner roll has a textured outer surface with embedded sharp grit to remove the debris on the movable surface;

wherein the rotatable cleaner roll is formed from a material having a surface energy which allows the debris to be dislodged and displaced from the major surface;

wherein any dislodged material is carried out by a print media in the printing system.

2. The system according to claim 1, wherein speed of the rotatable cleaner roll is matched to linear surface speed as the movable surface it is cleaning.

3. The system according to claim 2, wherein the movable surface is selected from the group consisting external heat roll, fuser roll, belt fuser, spreader.

4. The system according to claim 3, wherein the rotatable cleaner roll comprise a brush made of wire or other stiff fibers that can withstand a movable surface operating temperature.

5. The system according to claim 3, wherein the material for the sharp grit is selected from the group consisting of alumina, tungsten carbide or silica.

6. The system according to claim 3, the system further comprising:

a controller to control rotational speed of the rotatable cleaner roll relative to the movable surface.

7. A method of cleaning a surface in a printing system, the method comprising:

moving a movable surface having a major surface with debris thereon;

rotating a rotatable cleaner roll supported on a frame disposed for rolling contact with the major surface, wherein the rotatable cleaner roll has a textured outer surface with embedded sharp grit to remove the debris on the movable surface; and controlling rotational speed of the rotatable cleaner roll relative to the movable surface:

wherein the rotatable cleaner roll is formed from a material having a surface energy which allows the debris to be dislodged and displaced from the major surface;

wherein any dislodged material is carried out by a print media during printing operations.

8. The method according to claim 7, wherein speed of the cleaner roll is matched to linear surface speed as the movable surface it is cleaning.

9. The method according to claim 8, wherein the movable surface is selected from the group consisting external heat roll, fuser roll, belt fuser, spreader.

10. The method according to claim 9, wherein the rotatable cleaner roll comprise a brush made of wire or other stiff fibers that can withstand a movable surface operating temperature.

11. The method according to claim 9, wherein the material for the sharp grit selected from the group consisting of alumina, tungsten carbide or silica.

12. A fusing system used in an electrophotographic imaging apparatus comprising in an operative relationship, at least one external heat roll, a fuser roll, a pressure roll, and a rotatable cleaner roller, the rotatable cleaner roll has a textured outer surface with embedded sharp grit enabled to clean the at least one external heat roll, the fuser roll in operative contact at a first location with the pressure roll, the fuser roll in operative contact at a second location with the at least one external heat roll, an external heat roll having two functions, to transfer heat to the fuser roll and to clean the debris or contamination from the fuser roll surface, said external heat roll having a predetermined surface roughness extending throughout its length and having substantially a same length as the fuser roll, and enabled to contact substantially the entire length of the fuser roll and enabled to effectively remove debris on substantially any portion of the surface of the fuser roll during cleaning;

wherein the rotatable cleaner roll is formed from a material having a surface energy which allows the debris to be dislodged and displaced from the at least one external heat roll;

wherein any dislodged material is carried out by a print media in the electrophotographic imaging apparatus.

13. The fusing system according to claim 12, wherein cleaner roll speed is matched to a linear surface speed of the at least one external heat roll.

14. The fusing system according to claim 13, wherein the rotatable cleaner roll comprise a brush made of wire or other stiff fibers that can withstand the at least one external heat roll operating temperature.

15. The fusing system according to claim 13, wherein material for the sharp grit is selected from the group consisting of alumina, tungsten carbide or silica.

16. A cleaning cartridge to remove debris from a movable surface comprising:

a frame; and a rotatable cleaner roll supported on the frame disposed for rolling contact with a major surface, wherein the rotatable cleaner roll has a textured outer surface with embedded sharp grit to remove debris on the movable surface;

wherein the rotatable cleaner roll is formed from a material having a surface energy which allows the debris to be dislodged and displaced from the major surface;

wherein any dislodged material is carried out by a print media in a printing cleaning cartridge.

17. The cleaning cartridge according to claim 16, wherein the movable surface is selected from the group consisting external heat roll, fuser roll, belt fuser, spreader.

18. The cleaning cartridge according to claim 17, wherein the rotatable cleaner roll comprise a brush made of wire or other stiff fibers that can withstand a movable surface operating temperature.

19. The cleaning cartridge according to claim 18, wherein the material for the sharp grit selected from the group consisting of alumina, tungsten carbide or silica.

20. The cleaning cartridge according to claim 16, the cleaning cartridge further comprising:

a mechanism to control rotational speed of the rotatable cleaner roll relative to the movable surface;

wherein speed of the cleaner roll is matched to a linear surface speed as the movable surface it is cleaning;

wherein the movable surface is selected from the group consisting external heat roll, fuser roll, belt fuser, spreader;

wherein the rotatable cleaner roll is formed from a material having a surface energy which allows the debris to be dislodged and displaced from the major surface.

* * * * *